US005194314A

United States Patent [19]

Hooft

[11] Patent Number: 5,194,314

[45] Date of Patent: Mar. 16, 1993

[54] LAYERED SYNTHETIC MATERIAL SEALED WITH A FOIL HAVING APERTURES AND A FABRIC BACKING

[75] Inventor: Johannes W. G. Hooft, Hagestein, Netherlands

[73] Assignee: Multifoil B.V., Netherlands

[21] Appl. No.: 765,572

[22] Filed: Sep. 25, 1991

Related U.S. Application Data

[62] Division of Ser. No. 454,701, Dec. 21, 1989, abandoned.

[30] Foreign Application Priority Data

Dec. 29, 1988 [NL] Netherlands ..... 8803915

[51] Int. Cl.[5] ..... E06B 3/24; B32B 3/00

[52] U.S. Cl. ..... 428/138; 428/77; 428/78; 428/136; 428/137; 428/457; 428/285; 428/34; 428/178; 428/188; 428/192; 428/193; 428/122; 428/127; 428/128; 52/204.52; 362/336; 362/356; 362/367

[58] Field of Search ..... 428/138, 77, 78, 136, 428/137, 457, 285, 34, 178, 188, 192, 193, 122, 127, 128; 362/336, 356, 367; 52/304

[56] References Cited

U.S. PATENT DOCUMENTS

| | | | |
|---|---|---|---|
| 2,905,072 | 9/1959 | Oswald | 52/101 |
| 4,303,969 | 12/1981 | Hamilton et al. | 362/367 |
| 4,544,993 | 10/1985 | Kirk | 362/367 |
| 4,656,803 | 4/1987 | Chludil | 52/304 |

*Primary Examiner*—Ellis P. Robinson
*Assistant Examiner*—William P. Watkins, III
*Attorney, Agent, or Firm*—Rosen, Dainow & Jacobs

[57] ABSTRACT

Method for the sealing of the openings in the end surfaces of a sheet-shaped synthetic material that consists of two or more outer plates which are mainly flat and which are mounted on partitions. The partitions are spaced roughly even distance from one another and run along the total length of the material. Over every end opening a dust-proof, water-vapor permeable and ventilating non-woven first foil, e.g., of polyester fabric, is put, and on top of or under that one or more strips of a second foil, e.g. of aluminum, are put, of which the edges are beaten around and secured to the outer plates. This is done in such a way that every end opening discharges, at least partially, through a part of the first foil which is not covered by the second foil. The invention also comprises the foil material to be used, preferably consisting of two strips of foils as described, fixed against each other, before being put over the openings. An intended use is as a transparent covering for light streets.

7 Claims, 1 Drawing Sheet

LAYERED SYNTHETIC MATERIAL SEALED WITH A FOIL HAVING APERTURES AND A FABRIC BACKING

This is a division of application Ser. No. 07/454,701, filed Dec. 21, 1989, abandoned.

BACKGROUND OF THE INVENTION

The invention relates to a method for the sealing of the openings in the end surfaces of a sheet-shaped synthetic material that consists of two or more outer plates which are mainly flat and which are installed on partitions or walls which are placed on mainly even distance from one another and run along the total length of the material, more or less parallel.

Such plates of synthetic material are used, for instance, as a covering for light streets, for example, such as an outdoor shopping street overroofed with a light-permeable plate to permit light through but protect shoppers against rain. The synthetic material which is then chosen is light permeable, like for instance the polycarbonates known as 'Lexan', 'Macrolon' and perspex. The coverings then consist of one or more layers of adjoining, parallel grooves with a roughly rectangular diameter, lying between two outer plates.

In order to prevent dampness, fungus etc. from penetrating the grooves, the end openings of these are sealed with a material that is dust-proof, water-vapour permeable and ventilating. Such materials are known. Certain so-called 'non-woven' synthetics meet the set demands. Then, such a material is put, as a foil, over the openings, so that it is stuck against the outer plates, on both sides of the openings.

In actual practice, such a sealing does not suffice: the mechanical strength of the foil mentioned proves insufficient and it also proves to be impossible to stick the foil tight enough to the synthetic (outer plates).

SUMMARY OF THE INVENTION

The invention is founded on the perception that it is possible to make a sealing of the end openings that combines the characteristics of a material like the non-woven synthetic mentioned, and the favourable mechanical qualities showing with foils of other materials like aluminum.

The method for sealing the openings mentioned, according to the invention, is characterized thus, that over every opening a dust-proof, water-vapour permeable and ventilating first foil is put, and on top of that one or more strips of a second foil are put, of which the edges are beaten around the outer plates, and which are fixed to these outer plates. This is done in such a way that every and opening discharges, at least partially, under a part of the first foil which is not covered by the second foil.

According to a preferential realization of the method of this invention, the first foil is put over at least a part of every opening, and on top of that one strip of the second foil is applied, provided with holes, placed in such a way, that after its attachment every opening discharges under at least one hole, and that the back side of every hole is covered totally by the first foil. A relatively wide strip of the second foil is stuck to the outer plates, for instance with an adhesive, put on the strip in advance. Of course, such an adhesive will be applied also where the second strip covers the ends of the partitions, and where it lies over the first foil. The holes in the second foil are, for instance, apertures that lie in a row, in the middle of the strip.

A simplification of the method according to the invention is achieved with another characteristic of it, by attaching the first foil, as a strip, over all openings. A way of applying the method according to the invention is that two strips of the second foil are applied on both sides of the strip of the first foil, leaving a part along the middle of the first foil uncovered. A further simplification, according to the invention, is achieved, when before the foils are applied, the first foil is already put together with the second foil and, in this realization of the method: is attached under the holes in the second foil, after which the whole is put over the openings.

Attaching the two foils to each other is realized by sticking them together, noting that when a second foil with holes is used, the holes need to be totally covered by the first foil.

In order to be sure that in the sealed canals no fungus and algae can thrive, to the first foil of, for instance, non-woven synthetics, before the foil is put over the openings, respectively attached to the second foil(s), an anti-fungus and anti-algae agent is added, and the foil is then subject to a treatment that diminishes the size of the pores of the material sufficiently to meet the conditions required.

The invention also includes a foil material with which the methods mentioned are preferably realized. Such a foil material is characterized thus, that it consists of a strip of a first foil that is dust-proof water vapour permeable and ventilating, which strip is attached to a second strip, on both sides, along its entire length, partially overlapping this second strip of a foil that possesses the required mechanical qualities. It is therefore a composite foil, that, viewed from above, consists of three paths of foil material, the first foil being in the middle.

In a preferred embodiment, the second foil features holes that are covered by the first strip and has a width greater than the first strip and greater than the distance between the outer plates of the synthetic material. This way it can be beaten around the edges of the outer plates.

Preferably, the first foil consists of a non-woven synthetic and the second foil of aluminum, and in case the second foil is put on as one strip, the holes in that second foil are a row of apertures, lengthwise behind each other.

The invention also includes a sheet-shaped, synthetic construction as mentioned above, of which the end openings are sealed in a way and with a foil material as mentioned.

An example of the foil sealing according to the invention is as follows.

The openings in the end surface of a sheet-shaped construction of 'Lexan', as is meant here, were sealed with a first foil of a non-woven polyester with a weight of 25 g/m$^2$; a pore size, that was reduced form about 80 $\mu$m to less than 35 $\mu$m, by means of after-binding and calanding, so that it was sufficiently dust-proof; a thickness of 0.17 mm and a vapour permeability of 550 liter/m$^2$/sec.

The first foil was stuck, as a strip, to a second foil of aluminum with a thickness of about 40 $\mu$m and, including the adhesive, with a total thickness of about 60 $\mu$m all these covered with siliconated paper or polyethylene foil on the sticky side. The apertures, put in the middle in a row behind each other, the space between them about 5 mm, are about 2 cm long and about 3 mm wide.

The sheet sealed thus was tested during seven days; at temperatures of 20° C. and 80° C. the sheet was exposed to varying pulling strains, because of which a stretch of ½%, respectively 1% was brought about. It was shown that the mechanical qualities were not affected after the test, nor was the quality of the attachment of the aluminum to the Lexan. Also, the vapour permeability of the non-woven foil showed not to have been affected.

Also after a test during a month at a temperature of 40° C. and in an atmosphere with a humidity of 100%, no decline of the essential qualities was measured.

BRIEF DESCRIPTION OF THE DRAWINGS

The invention will be further explained with the help of the drawing, in which.

DESCRIPTION OF THE PREFERRED EMBODIMENTS

Figure 1:
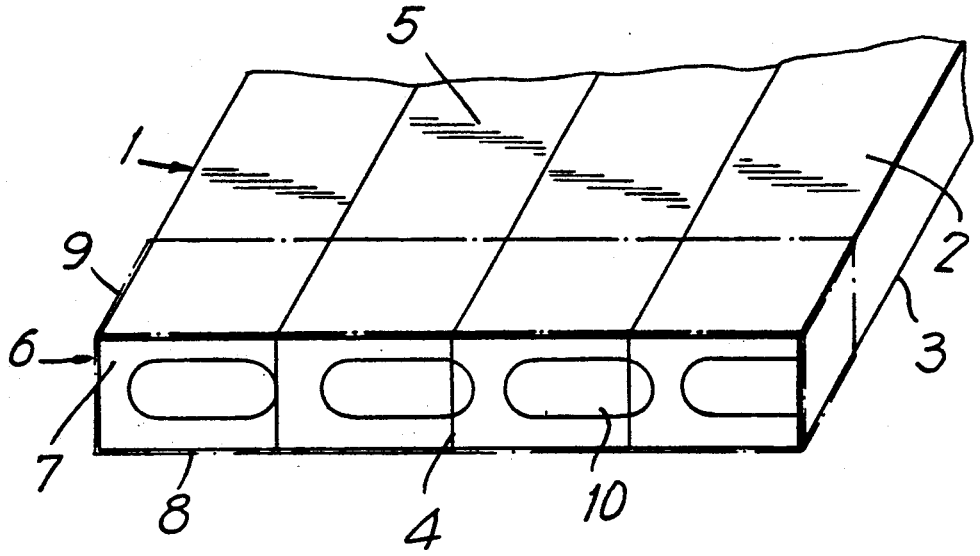
FIG. 1 is a front view, in perspective, of a sheet-shaped construction as meant in the example given, of which the openings in the end surface are sealed with a foil material according to the invention.

In FIG. 1, 1 is the sheet-shaped construction that consists of two outer plates 2 and 3, one on top, one on the bottom, with the partitions 4 in between. The canals 5 thus formed discharge in the end surface 6 each its own roughly rectangular openings 7. These openings 7 are sealed with a foil 8, for instance of aluminum, which is put over the openings 7 by beating the edges 9 of the foil 8 around the outer plates 2 and 3, and then sticking them to these plates. This foil 8, previously referred to as the second foil, contains holes 10, which in the given example are constructed as a row of apertures. The openings 7 of each of the canals 5 discharge under at least one of the holes 10.

Under each of the holes 10, and therefore over at least a part of every opening 7, lies a foil 11, previously referred to as the first foil, meeting these demands: dust-proof, vapour permeable and ventilating.

Figure 2:
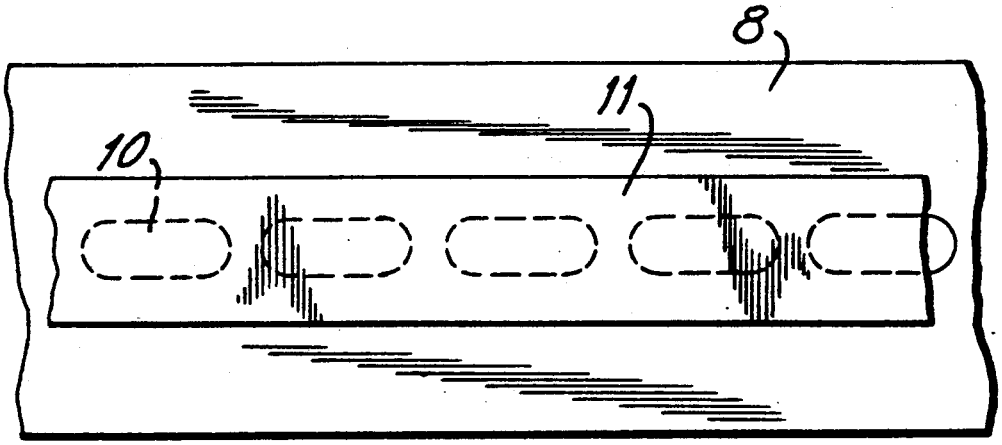
FIG. 2 is a view from above of the side of the foil material which is put over the openings when in use.

FIG. 2 shows in detail the composite foil material, of which the vapour-permeable etc. foil 11 is put over the holes 10 in advance. The width of the - second - foil 8 (vertical dimension in FIG. 2) is greater than the distance between both outer plates 2 and 3, so that a border 9 over the outer plates is always possible. These edges 9 are attached (stuck) to the outer sides of the outer plates 2 and 3.

In order to simplify applying the composite foil—a combination of the first and second foil in the situation drawn—foil 8 is generally provided, on its back side, with an adhesive layer, over which for protection, siliconated paper or a polyethylene foil is put, which can be pulled off when applying same.

I claim:

1. A synthetic sheet material comprising substantially light-permeable parallel plates separated by longitudinally extending walls defining parallel channels forming openings at the sheet ends, and a composite foil attached to the sheet ends and sealing off the end openings, said composite foil comprising a relatively-weak first foil strip and a relatively strong second foil strip, said second foil strip overlapping the parallel plates and being secured thereto and having apertures overlying the end openings, said first foil strip being attached to the second foil strip and overlying its apertures and being constituted of dust-proof, water-vapor-permeable and ventilating material wherein said material has pore openings of less than 80 μm such that it is sufficiently dust-proof.

2. A synthetic sheet material as claimed in claim 1, wherein the first foil strip is of a non-woven material, and the second foil strip is of aluminum.

3. A synthetic sheet material as claimed in claim 2, wherein the aluminum is beaten onto the plates in order to secure the aluminum thereto.

4. A synthetic sheet material as claimed in claim 1, wherein the second foil strip is wider than the first foil strip.

5. A synthetic sheet material as claimed in claim 4, wherein the second foil strip contain a series of holes that are completely covered by the first foil strip.

6. A synthetic sheet material as claimed in claim 5, wherein the holes are spaced apart and are arranged in a row along the middle of the second foil strip.

7. A synthetic sheet material as claimed in claim 1, wherein the synthetic sheet material is in the form of a plate used as a covering for light streets.

* * * * *